US009035244B2

(12) United States Patent
Rafferty et al.

(10) Patent No.: US 9,035,244 B2
(45) Date of Patent: May 19, 2015

(54) AUTOMATIC GAIN CONTROL WITH DEFOCUSING LENS

(71) Applicant: 1st Detect Corporation, Austin, TX (US)

(72) Inventors: David Rafferty, Webster, TX (US); Michael Spencer, Manvel, TX (US); James Wylde, Oak Leaf, TX (US); David Lorenz Gardner, League City, TX (US); Warren Mino, Friendswood, TX (US)

(73) Assignee: 1st Detect Corporation, Austin, TX (US)

( * ) Notice: Subject to any disclaimer, the term of this patent is extended or adjusted under 35 U.S.C. 154(b) by 0 days.

(21) Appl. No.: 14/202,531

(22) Filed: Mar. 10, 2014

(65) Prior Publication Data

US 2014/0252222 A1 Sep. 11, 2014

Related U.S. Application Data

(60) Provisional application No. 61/851,670, filed on Mar. 11, 2013.

(51) Int. Cl.

| | |
|---|---|
| ***H01J 49/38*** | (2006.01) |
| ***H01J 49/42*** | (2006.01) |
| ***H01J 49/14*** | (2006.01) |
| ***H01J 49/00*** | (2006.01) |
| ***H01J 49/06*** | (2006.01) |

(52) U.S. Cl.

CPC ..... *H01J 49/147* (2013.01); *H01J 49/0031* (2013.01); *H01J 49/0013* (2013.01); *H01J 49/067* (2013.01); *H01J 49/424* (2013.01); *H01J 49/4265* (2013.01)

(58) Field of Classification Search

USPC ..... 250/281, 282, 288, 423 R, 423 F, 284

See application file for complete search history.

(56) References Cited

U.S. PATENT DOCUMENTS

| | | | | |
|---|---|---|---|---|
| 2,773,212 | A | 12/1956 | Hall et al. | |
| 4,540,884 | A | 9/1985 | Stafford et al. | |
| 4,771,172 | A | 9/1988 | Weber-Grabau et al. | |
| 5,107,109 | A | 4/1992 | Stafford, Jr. et al. | |
| 5,324,939 | A * | 6/1994 | Louris et al. | 250/292 |
| 5,340,983 | A * | 8/1994 | Deinzer et al. | 250/281 |
| 5,479,012 | A | 12/1995 | Wells | |

(Continued)

FOREIGN PATENT DOCUMENTS

| | | |
|---|---|---|
| EP | 2 299 470 A2 | 3/2011 |
| EP | 2 442 351 A2 | 4/2012 |

OTHER PUBLICATIONS

Ann Westman-Brinkmalm et al., A mass spectrometer's building blocks, Mass Spectrometry—Instrumentation, Interpretation, and Applications, Jan. 1, 2009, p. 52.

(Continued)

*Primary Examiner* — David A Vanore

(74) *Attorney, Agent, or Firm* — Finnegan, Henderson, Farabow, Garrett & Dunner LLP

(57) ABSTRACT

A method and apparatus for performing mass spectrometry using an electron source, an ion trap, and a voltage-controlled lens located between the electron source and the ion trap. A controller applies a voltage to the lens. Features of the resulting output spectrum can be analyzed to determine whether to adjust the lens voltage.

14 Claims, 8 Drawing Sheets

(56) References Cited

U.S. PATENT DOCUMENTS

| | | | | |
|---|---|---|---|---|
| 5,493,115 | A * | 2/1996 | Deinzer et al. | 250/281 |
| 5,561,292 | A | 10/1996 | Buckley et al. | |
| 5,654,542 | A * | 8/1997 | Schubert et al. | 250/282 |
| 5,703,358 | A * | 12/1997 | Hoekman et al. | 250/282 |
| 5,710,427 | A * | 1/1998 | Schubert et al. | 250/282 |
| 5,808,299 | A | 9/1998 | Syage | |
| 6,294,780 | B1 | 9/2001 | Wells et al. | |
| 6,492,640 | B2 | 12/2002 | Terakura | |
| 6,600,154 | B1 * | 7/2003 | Franzen et al. | 250/282 |
| 6,710,334 | B1 | 3/2004 | Twerenbold | |
| 6,878,929 | B2 | 4/2005 | Green et al. | |
| 6,888,133 | B2 | 5/2005 | Wells et al. | |
| 6,894,275 | B2 * | 5/2005 | Green et al. | 250/281 |
| 7,291,845 | B2 * | 11/2007 | Moeller et al. | 250/427 |
| 7,459,677 | B2 * | 12/2008 | Geist et al. | 250/288 |
| 7,622,713 | B2 * | 11/2009 | Quarmby et al. | 250/288 |
| 7,858,933 | B2 * | 12/2010 | Kawana et al. | 250/288 |
| 7,939,810 | B2 * | 5/2011 | Kawana et al. | 250/423 R |
| 7,960,692 | B2 * | 6/2011 | Dobson et al. | 250/283 |
| 8,334,505 | B2 * | 12/2012 | Robinson et al. | 250/288 |
| 8,334,506 | B2 * | 12/2012 | Rafferty | 250/288 |
| 8,426,805 | B2 * | 4/2013 | McCauley | 250/282 |
| 8,704,168 | B2 * | 4/2014 | Rafferty | 250/283 |
| 8,754,371 | B2 * | 6/2014 | Hunter et al. | 250/294 |
| 2002/0175280 | A1 | 11/2002 | Franzen | |
| 2006/0192101 | A1 | 8/2006 | Takada et al. | |
| 2009/0194681 | A1 | 8/2009 | McCauley | |
| 2010/0084549 | A1 | 4/2010 | Ermakov et al. | |
| 2012/0205534 | A1 | 8/2012 | Hunter et al. | |

OTHER PUBLICATIONS

Yttria-Coated Iridium Cathodes Rugged Thermionic Emitters, Aug. 17, 2009, pp. 1-2.

PCT International Search Report and Written Opinion dated Sep. 16, 2014 in corresponding International Application No. PCT/US2014/021184, 14 pages.

* cited by examiner

| Lens Voltage | Number of Ions In Ion Trap |
|---|---|
| -81 V | 89 |
| -80 V | 133 |
| -79 V | 164 |
| -78 V | 175 |
| -77 V | 191 |
| -76 V | 198 |
| -75 V | 202 |
| -74 V | 209 |
| -73 V | 213 |
| -72 V | 216 |
| -71 V | 194 |
| -70 V | 170 |

Fig. 5

AUTOMATIC GAIN CONTROL WITH DEFOCUSING LENS

RELATED APPLICATION

This application claims priority to U.S. Provisional Application 61/851,670, filed Mar. 11, 2013. The content of this application is incorporated herein in its entirety.

FIELD OF THE DISCLOSURE

The present invention relates in general to mass spectrometry and, more particularly, to the control of a mass spectrometer apparatus by use of a voltage-controlled lens.

BACKGROUND OF THE DISCLOSURE

Mass spectrometers are instruments used to analyze the mass and abundance of various chemical components in a sample. Mass spectrometers work by ionizing the molecules of a chemical sample, separating the resulting ions according to their mass-charge ratios (m/z), and then measuring the number of ions at each m/z value. The resulting spectrum reveals the relative amounts of the various chemical components in the sample.

Electron ionization (EI) is one common method for generating sample ions. In EI, electrons are produced through a process called thermionic emission. Thermionic emission occurs when the kinetic energy of a charge carrier, in this case electrons, overcomes the work function of the conductor. In the vacuum chamber of the gas analyzer, where there may be virtually no gas to conduct heat away or react with the filament, a current through the filament quickly heats it until it emits electrons. The filament may be set to a voltage potential relative to an electron lens or other conductor, and the resulting electric field accelerates the electron beam towards the sample to be ionized. As the electron beam travels through the gaseous sample, the electrons may interact with and ionize and potentially fragment molecules in the sample. The charged particles can then be transported and analyzed using additional electric fields. EI can be performed either in the mass analyzer itself, or in an adjacent ionization chamber. The advantages of each system will be discussed with reference to the prior art below.

One type of mass analyzer used for mass spectrometry is called a quadrupole ion trap. Quadrupole ion traps take several forms, including three-dimensional ion traps, linear ion traps, and cylindrical ion traps. The operation in all cases, however, remains essentially the same. Direct current (DC) and time-varying radio frequency (RF) electric signals are applied to the electrodes to create electric fields within the ion trap. These fields trap ions within the central volume of the ion trap. Then, by manipulating the amplitude and/or frequency of the electric fields, ions are selectively ejected from the ion trap in accordance with their m/z. A detector records the number of ejected ions at each m/z as they arrive.

Ion traps are optimized for a combination of speed, sensitivity, resolution, and dynamic range depending on the particular application. For a given instrument, an improvement in one category is usually made at the expense of another. For example, resolution can generally be increased by using a slower scan, and in the reverse a scan can be performed faster at the expense of resolution. Similarly, sensitivity—especially to less abundant components of a sample—can be increased by trapping and scanning a larger total number of ions in a single scan. However, as the quantity of ions in the trap increases, the coulombic forces between the like-charged ions in the trap cause expansion of the ion cloud. When this occurs, ions at different locations within the cloud perceive slightly different electric fields. Mass spectrometers achieve resolution by ejecting all ions of the same m/z at close to the exact same moment, but when different ions of the same m/z perceive different electric fields, they may eject from the trap at different times. The result may cause broadening of spectral peaks referred to as the "space charge" effect. Space charge may also be caused by collisions when ions strike one another, particularly when large ions strike smaller ions. This increases the kinetic energy of some ions, thus ejecting them out of the ion trap before they would otherwise be removed by changes in the ion trap electrode potential.

Furthermore, specific components of a mass spectrometer may limit various performance specifications of the instrument. For example, a typical channel electron multiplier (OEM), a common type of ion detector, has a dynamic range of 2-3 orders of magnitude, which sets a ceiling for the overall system dynamic range independently of the performance of the mass analyzer. Thus, the design of other components of the instrument need to take these effects into account.

Conventional mass spectrometers have sought to achieve a balance between sensitivity and resolution by optimizing the quantity of ions trapped. For example, mass spectrometers have tried to achieve these benefits by: adjusting the trap loading time, adjusting the ionization time, or adjusting the ionization rate. However, such arrangements still have drawbacks. As a result, there still exists a need for a mass spectrometer that allows for improved control of the rate of ionization, as well as a beneficial balance between sensitivity and resolution, while also minimizing the size of the mass analyzer, the length of mass scans, and the power consumption of the instrument.

SUMMARY OF THE DISCLOSURE

A mass spectrometer for analyzing sample molecules, consistent with the disclosed embodiments, comprises an electron source, configured to emit electrons; an ion trap for receiving the emitted electrons, such that the received electrons ionize one or more sample molecules in the trap; an ion detector for detecting ions exiting from the ion trap; and a controller. In one embodiment, the controller includes a first voltage-controlled lens located between the electron source and the ion trap, wherein the first lens has an aperture configured to allow the emitted electrons to pass through the first lens and enter the ion trap, and wherein the first lens is configured to adjust a rate by which the electrons enter the ion trap based on a voltage applied to the first lens; and a voltage controller configured to apply a voltage to the first lens.

BRIEF DESCRIPTION OF THE DRAWINGS

The drawings are not necessarily to scale or exhaustive. Instead, emphasis is generally placed upon illustrating the principles of the inventions described herein. The accompanying drawings, which are incorporated in and constitute a part of this specification, illustrate several embodiments consistent with the disclosure and together with the description, serve to explain the principles of the disclosure. In the drawings:

FIG. 5 shows a table of the number of resultant ions in the ion trap for several lens voltages in the simulation depicted in FIGS. 4A, 4B, and 4C.

DETAILED DESCRIPTION OF THE EMBODIMENTS

Reference will now be made in detail to the embodiments of the present disclosure described below and illustrated in the accompanying drawings. Wherever possible, the same reference numbers will be used throughout the drawings to refer to same or like parts.

Embodiments consistent with the present disclosure relate to a mass spectrometer having a voltage-controlled lens to control the number of electrons allowed into an ion trap of the spectrometer for ionizing the sample molecules. By monitoring a feature of the resulting output spectrum, the lens voltage may be adjusted to efficiently control the number of ions in the trap. For example, for low concentration samples, the number of electrons introduced to the trap may be increased, creating more ions in the trap and improving the detected signal. For higher concentration samples, the number of electrons may be reduced to avoid unwanted interactions in the trap that could reduce performance. Several methods for adjusting the lens voltage are thus disclosed in greater detail below.

Figure 1:
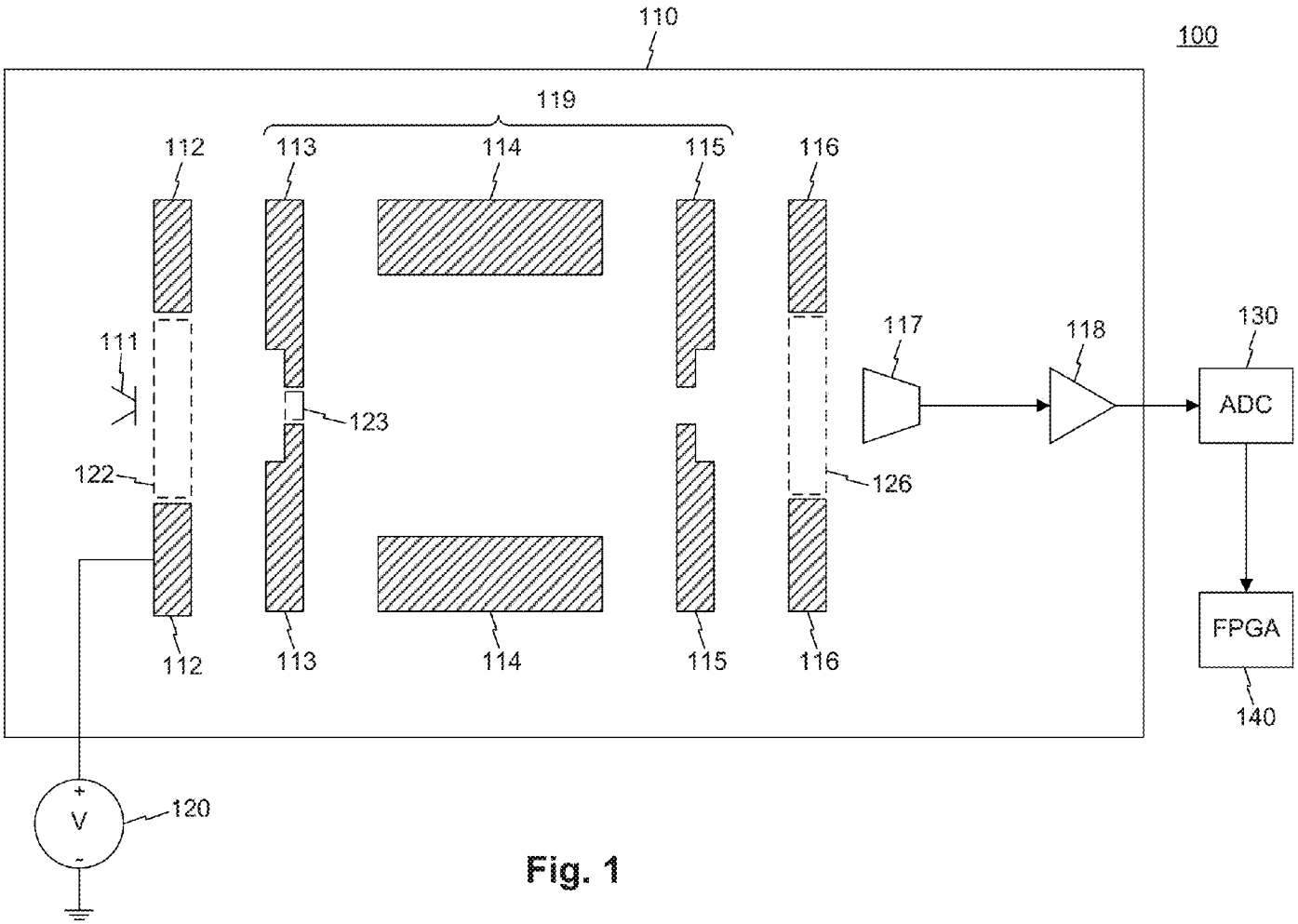
FIG. 1 is a simplified cross-sectional view of an embodiment of the invention.

FIG. 1 is a schematic diagram of a mass spectrometer 100 according to an embodiment of the invention. Mass spectrometer 100 may be used, as known in the art, to analyze a chemical sample. As shown in FIG. 1, an example embodiment of spectrometer 100 may include a vacuum chamber 110 that receives a control signal from a voltage controller 120 and that outputs a detection signal to an A/D converter 130, which is coupled to a field-programmable gate array ("FPGA") 140. In some embodiments, FPGA 140 may be a microprocessor, digital signal processor (DSP), or similar element. Turning to vacuum chamber 110 itself, it may further include an electron filament 111 for emitting electrons used to ionize the sample to be analyzed by spectrometer 100. The emitted electrons may pass through a first lens 112 and into an ion trap 119, which is shown as formed by a first end cap electrode 113, a ring electrode 114, and a second end cap electrode 115. Chamber 110 may also include a second lens 116, through which ions leaving the trap may pass before being received by a detector 118.

In one arrangement, electron filament 111 may be formed of an alloy that emits elections when heated with an electrical current. In one embodiment, the first lens 112 may have an aperture 122, such that lens 112 may be placed between the electron filament 111 and the first end cap electrode 113 of the ion trap 119. Lens 112 may comprise a single electrode or may comprise multiple electrodes as in an Einzel lens. The voltage controller 120 may then apply a voltage to lens 112 in order to apply an electric field for focusing electrons traveling from filament 111 towards ion trap 119. As shown in FIG. 1 and as discussed above, the ion trap 119 generally comprises the ring electrode 114, the first end cap electrode 113 having an entrance aperture 123, and the second end cap electrode 115 have an exit aperture. Although not shown in FIG. 1, mass spectrometers 100 consistent with embodiments of this disclosure may include a voltage source for applying a DC and RF voltage to the ring electrode 114 in order to create an electric field to trap or "store" molecules in ion trap 119.

As shown in FIG. 1, the second lens 116 may have an aperture 126 and be placed between the second end cap electrode 115 and the ion detector 117. In some embodiments, the second lens 116 shields the trap from the high potential of the detector. In one embodiment, aperture 126 may covered with a screen or grate to allow shielding of the ion trap 119 from the electric field generated by ion detector 117. For example, ion detector may be configured to have a high negative voltage to attract ions exiting ion trap 119. In one implementation, the ion detector 117 may be biased with a voltage on the order of −2,000 V. The output of ion detector 117 may be supplied to an ion amplifier 118. In an example embodiment, the ion amplifier 118 is in close proximity to the ion detector 117. In some embodiments, the ion amplifier 118 is a transimpedance amplifier that converts the low-level current output into a voltage. The ion amplifier 118 may thus serve to buffer the output of the ion detector 117, and allow for transmission of the detector's output signal to the A/D converter 130 via a low-impedance signal line that is less susceptible to electromagnetic interference than the output of the ion detector 117. The A/D converter 130 may thus translate the analog output of the ion amplifier 118 into a digital signal that may be read by the FPGA 140. As known in the art, the digital signal stored by FPGA 140 may be subsequently processed into an output spectrum to be read by the user or stored for future use. In other embodiments, the A/D converter 130 and FPGA 140 can be combined into a single complex device such as a DSP, microprocessor, or any combination of analog or digital components known in the art.

In the preferred embodiment, a current is run through electron filament 111 sufficient to heat it to a temperature high enough to cause it to emit electrons. When the voltage controller 120 applies a voltage to the lens 112, the resulting electric field focuses the emitted electrons into an electron beam, which may travel through the aperture 122 of lens 112. A portion of the electron beam may then enter the ion trap 119 through the aperture 123 in the first end cap electrode 113. The electrons in the beam will normally accelerate in accordance with the surrounding electric field. Accordingly, mass spectrometers 100 consistent with the example embodiments allow changing the relative voltages applied to the electron filament 111 and the lens 112 in order to influence the flight path of the electrons and the cross-sectional area of the electron beam, and thereby influence the proportion of electrons that pass through lens 112 and enter the ion trap 119. The lens 112 may thus function, in one example embodiment, as a voltage-controlled gate for controlling the number of electrons that enter the ion trap 119, and, in turn, the number of sample molecules ionized in the trap.

During the ionization period (the period during which sample molecules are ionized in the trap by the emitted electron beam), the DC and RF fields are applied to the ring electrode 114 in order to trap or "store" molecules of all m/z values within the range set for that scan. In some embodiments, a DC and RF voltage may also be applied to the first end cap electrode 113 and to the second end cap electrode 115. When the ionized sample molecules in the trap 119 are ready to be analyzed, the DC and RF electric signals are altered to eject ions progressively from ion trap 119 according to their m/z.

Figure 2A:
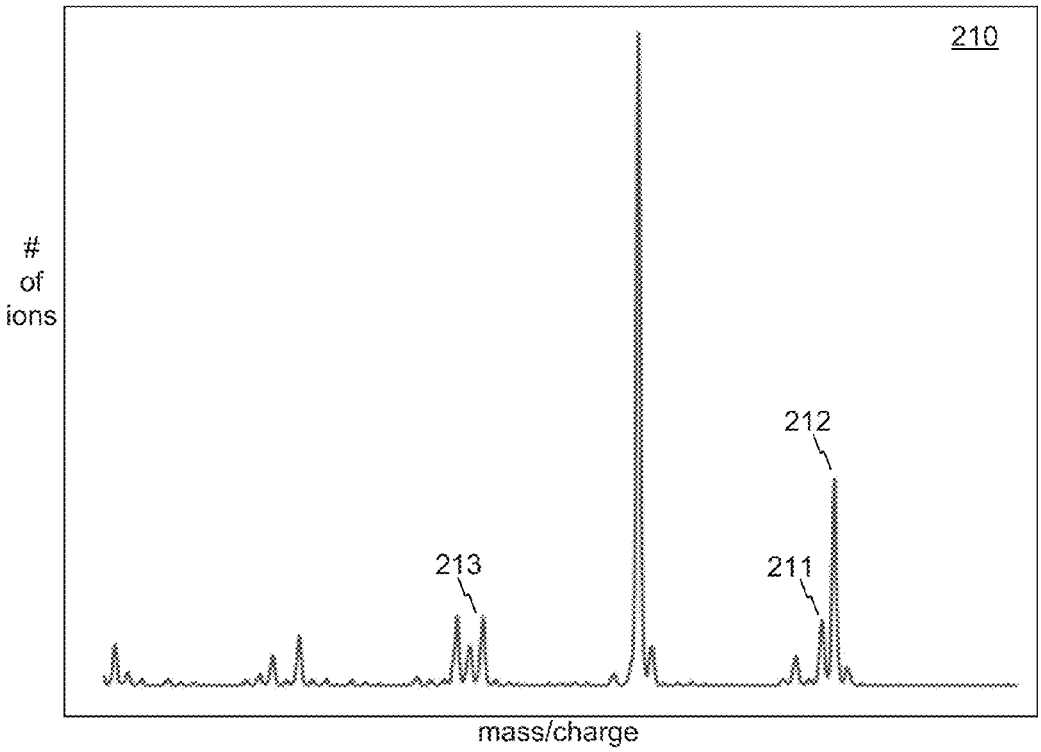
FIG. 2A shows example spectra without space charge effects.
Figure 2B:
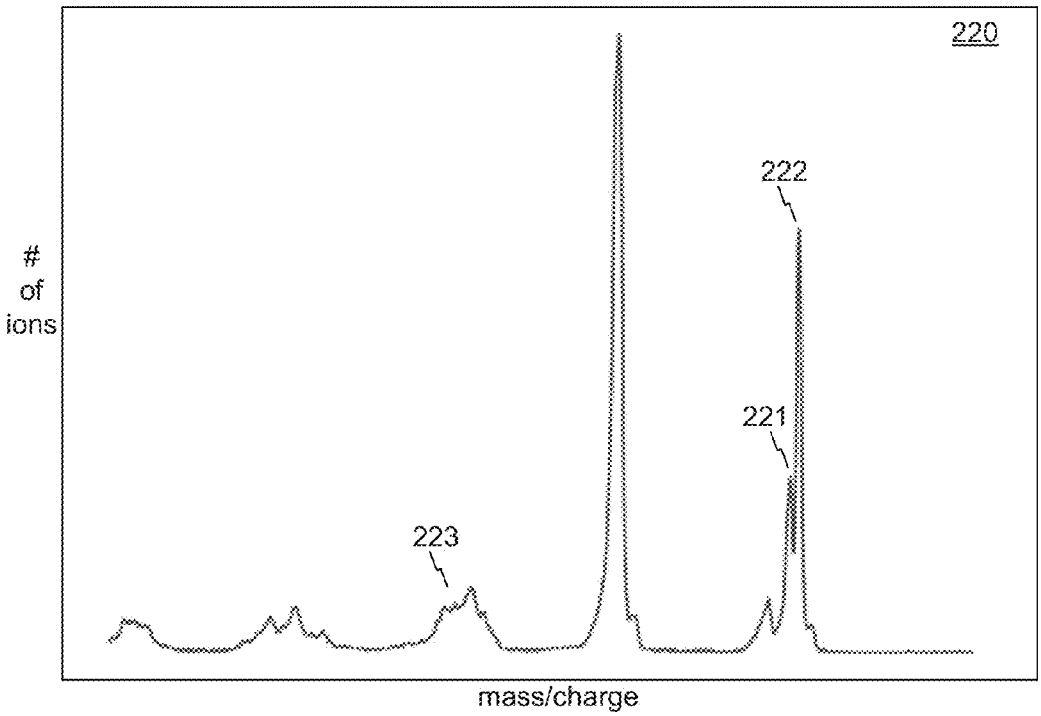
FIG. 2B shows example spectra with space charge effects.

FIG. 2A shows example spectra without space charge effects, and FIG. 2B shows example spectra with space charge effects. As described above, "space charge effects" generally refers to the effect caused by other charged molecules in the trap in addition to that caused by the external electrical field. In FIG. 2A, peaks 211 and 212 indicate the presence of two isotopes of the same ion. In the absence of space charge effects, the peaks are easily discernible. As the number of electron-molecule strikes increases, and thus the ion quantity inside the trap 119 increases, mass charge effects begin to manifest such that the spectral peaks widen and isotopes blur together. For instance, in FIG. 2B, the midpoint between peaks 221 and 222, which represent the same isotopes as peaks 211 and 212 in FIG. 2A, no longer drops back to baseline.

FIG. 2B also illustrates how space charge effects can be more pronounced at lower masses. The loss in resolution from peak 212 to 222 is not as severe as the loss of resolution from 213 to 223, where identification of isotopes, and in fact the identity of the main peak, has become impossible. Space charge effects manifest more at lower masses because ions are ejected in order from low mass to high mass. Low mass ions are ejected while the trap is still full, and are thus ejected when space charge effects are at their worst. By the time higher mass ions are ejected later in the scan, the quantity of ions in the trap has been reduced and the space charge effects have subsided. The spectra of FIGS. 2A and 2B thus illustrate the importance of controlling the quantity of ions analyzed in a single scan to properly balance sensitivity and resolution. If not enough ions introduced into the trap for analysis, then a peak, such as peak 213, may not be visible above the noise floor even though the taller peaks remain visible and identifiable. At the other end of the scale, when too many ions are introduced into the trap, then the ability to identify a peak precisely may be lost, even though the peak itself can be generally detected. In additional to the degradation in resolution, space charge also manifests itself as an unwanted shift in the m/z values of the spectral peaks.

Figure 3:
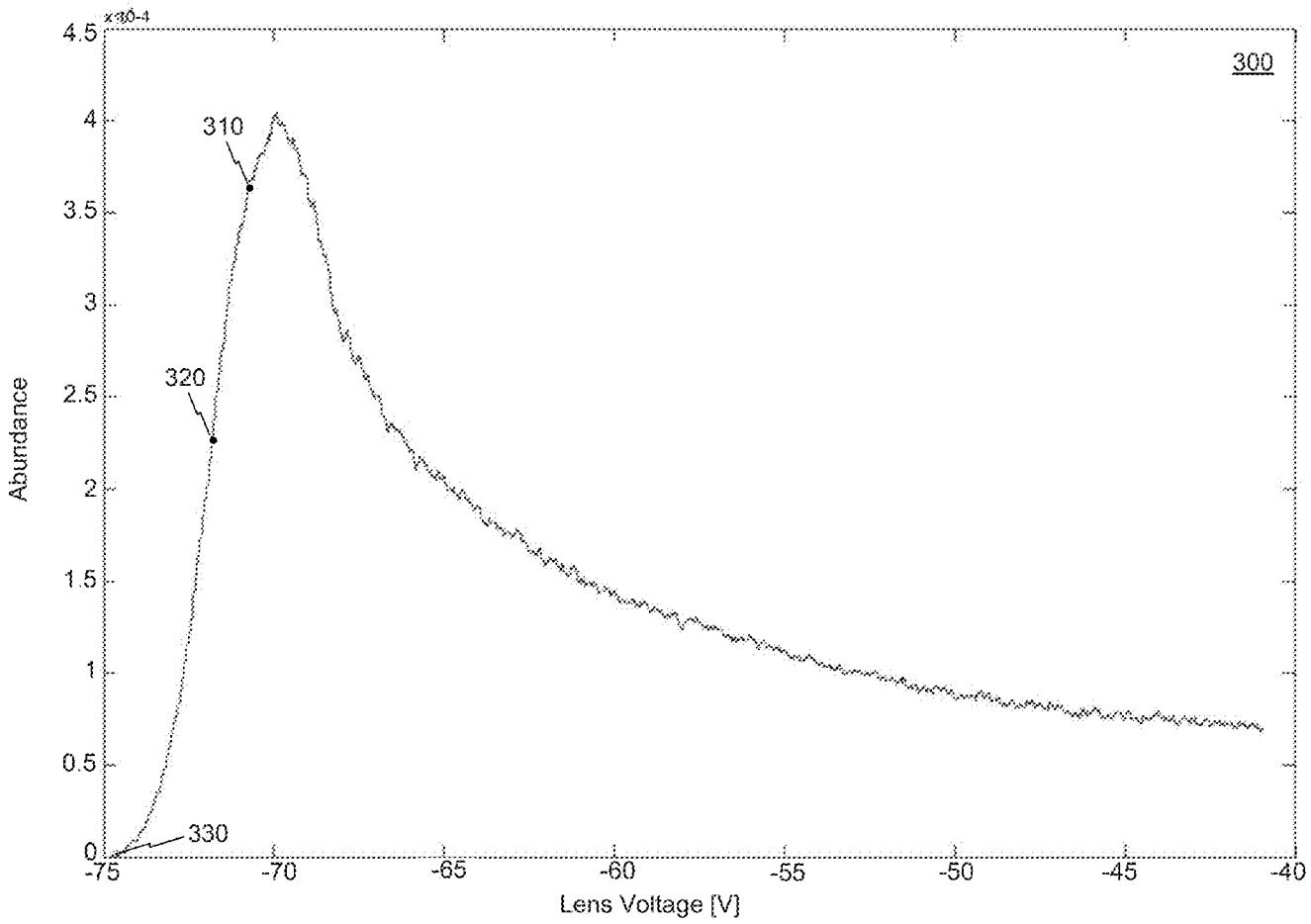
FIG. 3 shows simulation results of ion abundance versus lens voltage.

FIG. 3 shows data correlating ion abundance versus lens voltage. In other words, FIG. 3 illustrates how changes in the voltage applied to lens 112 by voltage source 120 may influence the amount of electrons emitted into ion trap 119 and thus, in turn, influence the amount of ions in trap 119. In the preferred embodiment, the lens 112 is operated on the left side of the operating curve, or at voltages between approximately −75 V and −70 V. On this side of the curve, the electron flux into the trap 119 is most sensitive to changes in the voltage applied to lens 112 by the voltage source 120. Specifically, on this side of the curve, the ion trap 119 may go from nearly pinched off (minimal emitted electrons) at operating point 330 to full electron flux at point 310 over a narrow voltage range.

Figure 4A:
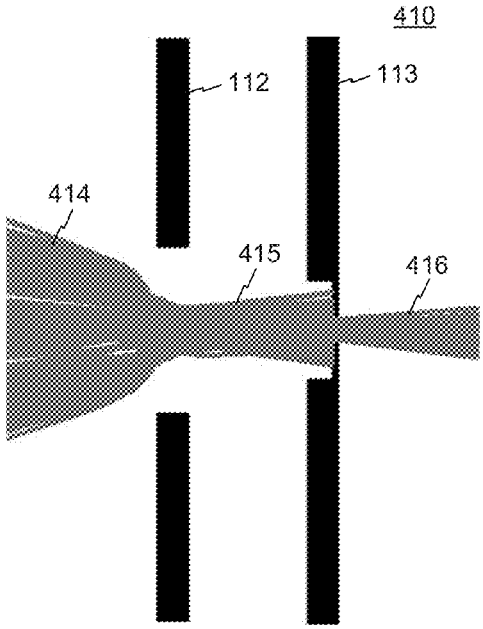
FIG. 4A depicts simulated flight paths of electrons emitted from the filament at an exemplary lens voltage.
Figure 4B:
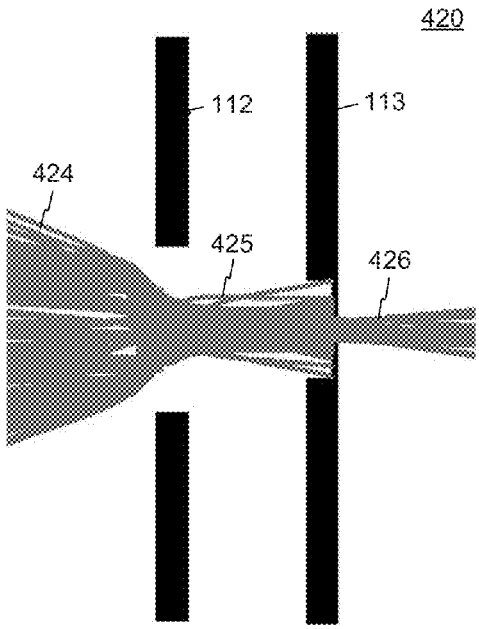
FIG. 4B depicts simulated flight paths of electrons emitted from the filament at another exemplary lens voltage.
Figure 4C:
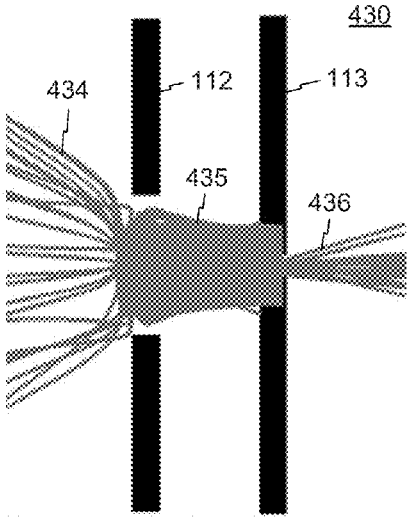
FIG. 4C depicts simulated flight paths of electrons emitted from the filament at yet another exemplary lens voltage.

FIGS. 4A, 4B, and 4C depict simulated flight paths of electrons emitted from the filament 111 for various lens voltages. These simulations, for purposes of illustration only, were produced with SIMION, an ion optics simulation software program. At the highest negative potential, as shown in FIG. 4A, most of the electrons are ejected to the left 414 away from the lens 112, and only a relatively small portion of the electrons 415 pass through the lens 112. As the voltage is increased, as shown in FIG. 4B, fewer electrons 424 are directed away from lens 112, and a greater proportion of electrons 425 pass through the lens 112, resulting in more electrons 426 entering the ion trap. Finally, when the voltage is increased to that as shown in FIG. 4C, the maximum proportion of electrons 435 pass through the lens 112, which results in the maximum number of electrons 436 entering the ion trap 119. The number of ions resulting from the electrons that enter the ion trap for several lens voltages between −81 V and −70 V are displayed in a table in FIG. 5. The data of FIG. 5 is intended to be exemplary and for illustrative purposes, as the actual number of electrons entering the trap at various voltages may depend on a variety of factors, such as the structure and geometry of the lens 112 and of ion trap 119. As shown in the data of FIG. 5, however, increasing the voltage of lens 112 from −81 V to −72 V, causes an increase in the amount of ions in the ion trap. Increasing the voltage beyond −72 V in this example, however, causes the number of ions to decrease.

In embodiments consistent with this disclosure, lens 112 can also be used to prevent positive ions caused by contamination of the filament 111 or ions generated by thermal ionization due to neutrals getting close to the filament 111 from corrupting the output spectrum of mass spectrometer 100. In one preferred embodiment, the electron filament 111 is an yttria-coated iridium disc. If such a filament becomes contaminated, it can emit positive ions. This can occur even when the filament current is well below the specified value for electron production. When the filament emits positive contaminant ions during the ejection phase of a scan, those ions can find their way into the ion trap 119 and cause noise or spurious peaks in the mass spectrum.

In one embodiment, lens 112 may be set to approximately −70 V during the ionization period of the scan, during which the electron beam enters the trap and ionizes the sample molecules. During the ejection period of the scan, lens 112 may be set to +70 V to attract all of the electrons away from end cap entrance aperture 123. A possible problem with this method is that the +70 V applied to the lens during the ejection period of the scan can cause focusing of the positive contaminant ions in the same manner that the −70 V on the lens during the ionization period focuses electrons. Focusing of the positive ions can increase the amount of noise or spurious peaks due to the positive contaminant ions.

In one preferred embodiment, electron filament 111 may be switched to a moderate negative voltage, such as −15 V, during the ejection period of the scan. With lens 112 set to −70 V and the filament 111 set to −15 V, electrons are confined to the ionizer surface preventing electron ionization. At the same time, any ions generated at or near the filament due to contaminants on the filament or thermal ionization of nearby neutrals will be attracted to the more negative voltage of the lens disk, preventing them from reaching the detector. Alternately, during the ejection period, the filament 111 may be biased to a fraction of the lens 112 voltage, such as 50%, and the first end cap 113 set to at or near ground, the electric field will still repel electrons away from the trap to prevent unwanted ionization during the scan. The negative voltage applied to lens 112 is still high enough, however, to attract any positive contaminant ions that may form in ion trap 119, and prevent them from entering the trap.

Figure 6A:
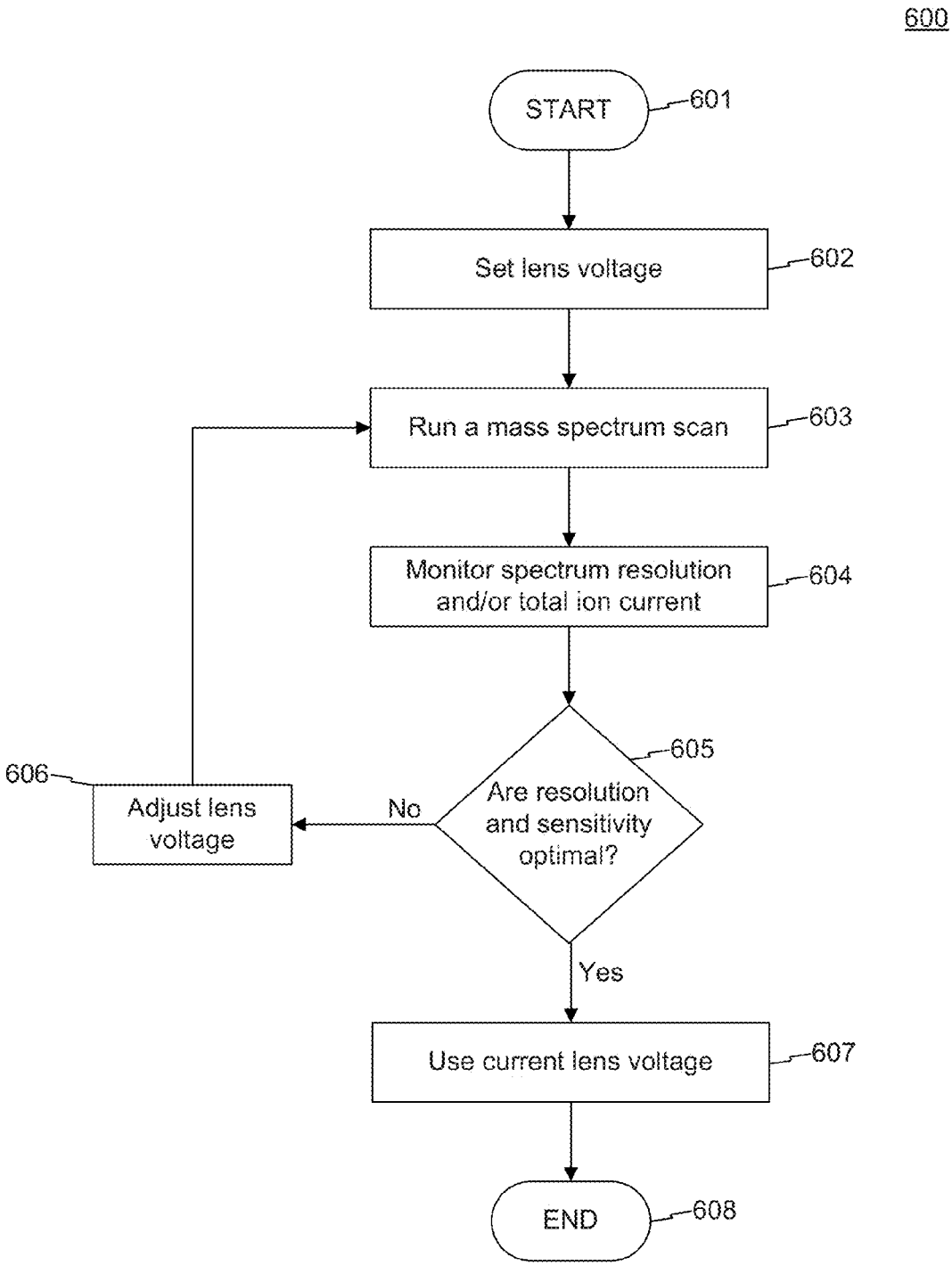
FIG. 6A shows a flow chart illustrating steps in a first exemplary method for adjusting the focal length of the lens.
Figure 6B:
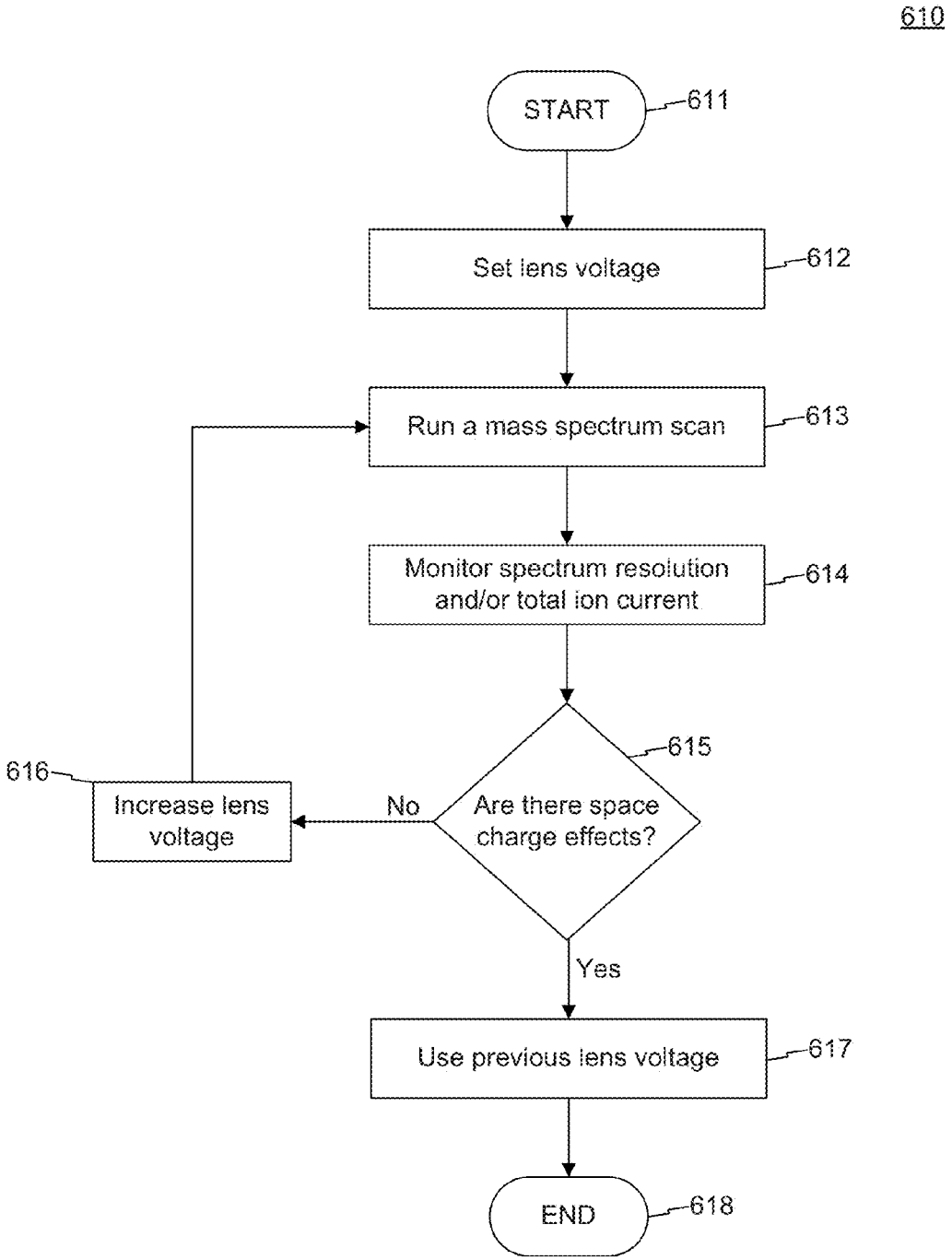
FIG. 6B shows a flow chart illustrating steps in a second exemplary method for adjusting the focal length of the lens.
Figure 6C:
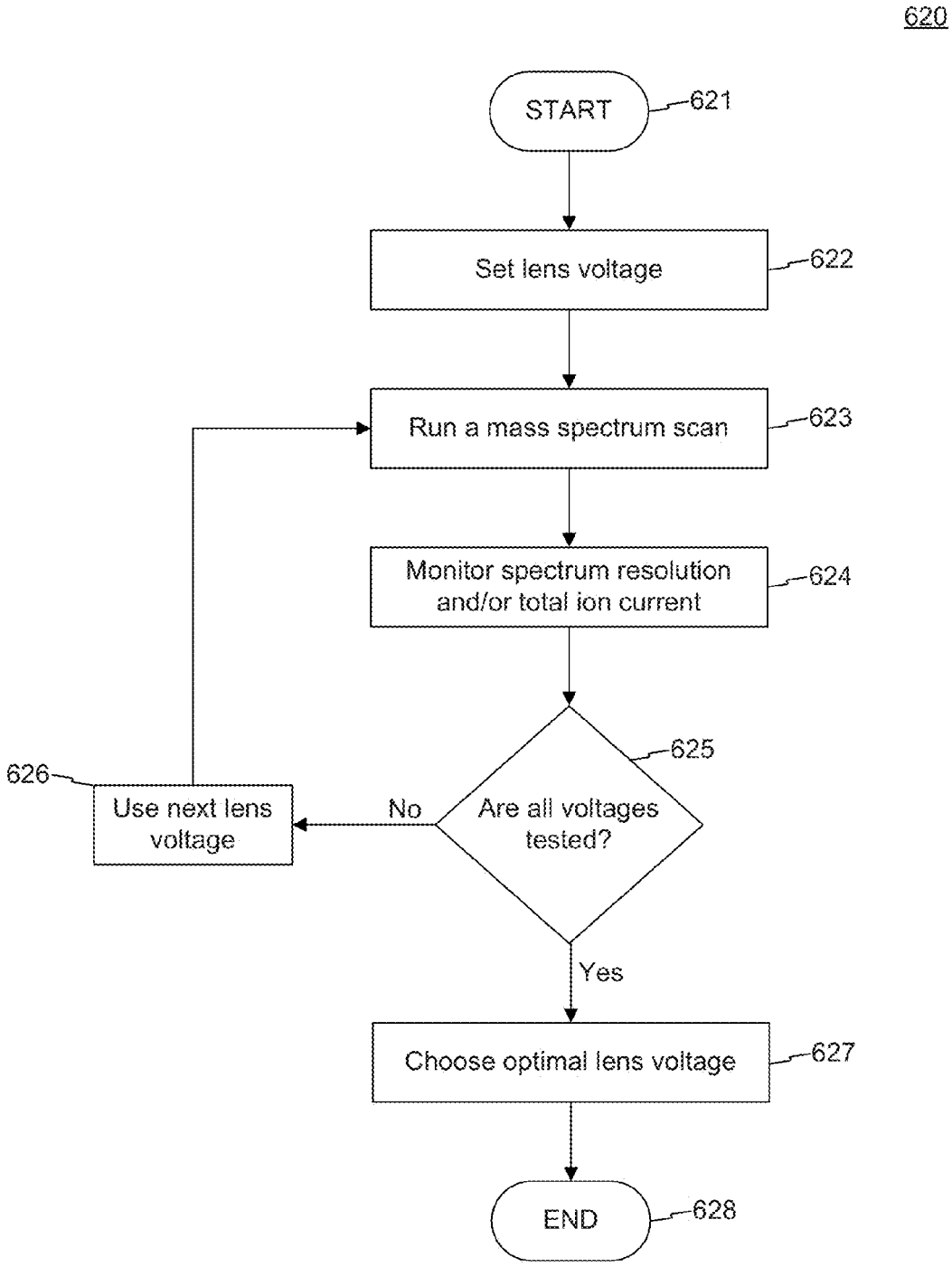
FIG. 6C shows a flow chart illustrating steps in a third exemplary method for adjusting the focal length of the lens.

FIGS. 6A, 6B, and 6C show several flow charts illustrating steps in exemplary methods for adjusting the focal length of the lens. FIG. 6A illustrates a process 600, that begins at step 601, for adjusting the lens voltage for purposes of optimizing the resolution or sensitivity of the mass spectrometer 100. In the embodiment shown in FIG. 6A, an initial voltage is set and applied to the lens in step 602. This voltage may be adjusted to set the focal length of the lens, e.g., lens 112. In one implementation, the initial voltage is a predetermined value set to a low end of the relevant operating range. Next, the mass spectrometer 100 operates, in step 603, to performs a mass spectrum scan of a sample introduced into trap 119.

When the spectrometer 100 performs the scan of the sample during step 603, the spectrometer 100 will operate during its ionization period based on the voltage value set in step 602. The mass spectrometer 100 may then monitor the spectrum resolution and/or total ion current in step 604. In some embodiments, the spectrum resolution may be in terms of the full width at half maximum (FWHM) of a peak in the spectrum. If the resolution and sensitivity of the resulting spectrum are optimal or meet predetermined criteria, as decided in step 605, then that lens voltage may be used for subsequent scans in steps 607 to 608. Otherwise, the lens voltage is adjusted in step 606 and repeats the mass spectrum scan of step 603. In example embodiments, the voltage source 120 may incrementally adjust the lens voltage according to preset amounts. For example, in one embodiment, the lens voltage is adjusted in 10% increments of an identified operating range. If, for instance, the operating range is identified to be −75 to −70 volts, as described above with respect to FIG. 3, then the lens voltage may be adjusted in 0.5 V increments, beginning at −75 V.

The iterative process of steps 603 to 606 may continue until the resolution and sensitivity of the spectrum are considered to be optimal or meet the predetermined criteria. By setting the predetermined parameters to be evaluated in step 605, a user can decide based on the application whether to sacrifice spectral resolution at the cost of improving sensitivity, or whether to increase sensitivity at the expense of resolution in the low end of the mass range. This is not always a trade-off; resolution may be maintained over the dynamic range of the instrument until the onset of space charge, so long as the instrument is operating below the maximum resolution. In other embodiments, the optimal point is preprogrammed and unchangeable, which may be beneficial in applications where simplicity of use is valued over flexibility.

FIG. 6B illustrates a process 610, that begins at step 611, for adjusting the lens voltage for purposes of controlling space charge effects of the mass spectrometer 100. In the embodiment shown in FIG. 6B, the method begins by setting the voltage applied by voltage source 120 to the lens 112 in step 612. This voltage sets the focal length of the lens. Next, the instrument performs a mass spectrum scan in step 613, and monitors the spectrum resolution and/or total ion current in step 614. If there are no space charge effects, as decided in step 615, the previous voltage is accepted and used for subsequent scans. For extremely low concentrations, the user may monitor the signal-to-noise ratio and increase accordingly the number of ions created in a reverse of this process. Otherwise, the lens voltage is increased in step 616 and another mass spectrum scan is performed in step 613. This iterative process continues until space charge effects are no longer observed. In this manner, the voltage on lens 112 is increased step by step to allow more electrons into the trap and generate more ions. At each step, a mass spectrum is taken and observed for signs of space charge effects. When a space charge effect is detected, the instrument reverts to the previous lens voltage that didn't result in space charge effects.

In yet another embodiment, as shown in FIG. 6C, the instrument steps through a finite list of possible voltage settings. The method begins by setting the voltage of voltage source 120 to be applied to the lens 112 to one of the voltages in the list in step 622. Next, the mass spectrometer 100 performs a mass spectrum scan in step 623, and monitors the spectrum resolution and/or total ion current in step 624. If there are more possible voltages in the list to test (step 625; yes), then the lens voltage is adjusted to the next lens voltage on the list in step 626 and repeats the mass spectrum scan of step 623. The iterative process continues until all lens voltages have been tested. In step 627, the optimal lens voltage, as determined by the monitored spectrum resolution and/or total ion current in step 624 for each voltage, is used for subsequent scans.

The foregoing description, along with its associated embodiments, has been presented for purposes of illustration only. It is not exhaustive and does not limit the invention to the precise form disclosed. Those skilled in the art will appreciate from the foregoing description that modifications and variations are possible in light of the above teachings or may be acquired from practicing the invention. The steps described need not be performed in the same sequence discussed or with the same degree of separation. Likewise various steps may be omitted, repeated, or combined, as necessary, to achieve the same or similar objectives. Accordingly, the invention is not limited to the above-described embodiments, but instead is defined by the appended claims in light of their full scope of equivalents.

What is claimed is:

1. A mass spectrometer for analyzing sample molecules, comprising:

an electron source, configured to emit electrons;

an ion trap for receiving the emitted electrons, such that the received electrons ionize one or more sample molecules in the trap;

an ion detector for detecting ions exiting from the ion trap; and a controller, including:

a first voltage-controlled lens located between the electron source and the ion trap, wherein the first lens has an aperture configured to allow the emitted electrons to pass through the first lens and enter the ion trap, and wherein the first lens is configured to adjust an electron-entry rate by which the electrons enter the ion trap based on a control voltage applied to the first lens, such that the electron-entry rate is configured, based on an adjustment of the control voltage, to be adjusted between a first nonzero rate and a second nonzero rate; and a voltage controller configured to apply the control voltage to the first lens.

2. The mass spectrometer of claim 1, wherein the ion trap consists of a ring electrode, a first end cap electrode with an entrance aperture, and a second end cap electrode with an exit aperture.

3. The mass spectrometer of claim 2, wherein the lens aperture is wider than the entrance aperture of the first end cap electrode.

4. The mass spectrometer of claim 1, further including:

a second lens with a second lens aperture positioned between the ion trap and the ion detector, wherein the second lens is configured to focus the ions towards the detector.

5. The mass spectrometer of claim 4, wherein the second lens aperture is covered with a screen for shielding the ion trap from an electric field generated by the detector.

6. The mass spectrometer of claim 1, wherein the second lens aperture is wider than the exit aperture of the second end cap electrode.

7. The mass spectrometer of claim 1, wherein the electron source comprises an electron filament composed of an yttria-coated iridium disc.

8. A method for controlling a mass spectrometer, wherein the method comprises:

applying a control voltage, set to an initial value, to a voltage-controlled lens located between an electron source and an ion trap of the mass spectrometer, wherein the electron source emits electrons through the voltage-controlled lens and into the ion trap;

emitting electrons to the ion trap through the voltage-controlled lens while the control voltage is applied to the voltage-controlled lens;

analyzing a sample in the ion trap and detecting a spectrum output;

measuring an output parameter of the spectrum output; and determining, based on the measured parameter, whether to adjust the control voltage.

9. The method of claim 8, wherein measuring the output parameter further includes:

measuring for possible space charge effects in the spectrum output;

determining, based on the presence of space charge effects, whether to adjust the control voltage; and using the final voltage for performing subsequent spectrum scans.

10. The method of claim 8, further including:

setting the initial value of the control voltage to about or greater than −70 V during a period of emitting electrons into the ion trap intended to ionize sample molecules in the ion trap.

11. The method of claim 8, further including:

setting the initial value of the voltage of the electron source to about −70 V during a period of introducing electrons into the ion trap.

12. The method of claim 8, further including:

setting the initial value of the voltage of the electron source to about −15 V during a period of ejecting ions from the trap towards a detector.

13. The method of claim 8, further including:

setting the initial value of the voltage of the electron source to about 50% of the control voltage during a period of ejecting ions from the trap towards a detector.

14. The method of claim 8, further including:

setting a DC component of the first end cap voltage to be between −15 V and +15 V during a period of ejecting ions from the trap.

* * * * *